US007153172B2

(12) United States Patent
Milligan et al.

(10) Patent No.: US 7,153,172 B2
(45) Date of Patent: Dec. 26, 2006

(54) FUEL INJECTOR CONNECTOR

(75) Inventors: Bob Milligan, San Jacinto, CA (US); Richard A. Van Dien, Hemet, CA (US); Robin D. Reed, Banning, CA (US)

(73) Assignee: Deutsch Engineered Connecting Devices, Inc., Hemet, CA (US)

( * ) Notice: Subject to any disclaimer, the term of this patent is extended or adjusted under 35 U.S.C. 154(b) by 0 days.

(21) Appl. No.: 11/133,820

(22) Filed: May 19, 2005

(65) Prior Publication Data

US 2006/0264119 A1 Nov. 23, 2006

(51) Int. Cl.
*H01R 13/514* (2006.01)

(52) U.S. Cl. ..... 439/752; 439/733.1

(58) Field of Classification Search ..... 439/752, 439/733.1, 595, 352, 372, 353, 686, 701
See application file for complete search history.

(56) References Cited

U.S. PATENT DOCUMENTS 4,225,206 A 9/1980 Roman, Jr.
4,722,231 A * 2/1988 Tanaka et al. ..... 73/861.12
5,181,862 A * 1/1993 Hawk et al. ..... 439/595
5,390,648 A 2/1995 Yanase
5,435,758 A * 7/1995 Sasai et al. ..... 439/752
5,593,313 A * 1/1997 Shibuya et al. ..... 439/373
5,647,772 A * 7/1997 Martucci et al. ..... 439/748
6,012,945 A 1/2000 Tabor et al.
6,250,972 B1 * 6/2001 Shinchi et al. ..... 439/752
6,491,542 B1 * 12/2002 Zerebilov ..... 439/489
6,722,922 B1 4/2004 Cykon et al.
6,827,609 B1 * 12/2004 Martin et al. ..... 439/595
2001/0025627 A1 10/2001 Lamb et al.
2002/0049007 A1 4/2002 Karell

* cited by examiner

*Primary Examiner*—Alexander Gilman
(74) *Attorney, Agent, or Firm*—O'Melveny & Myers LLP

(57) ABSTRACT

An electrical connector assembly for a fuel injector includes a receptacle and mating plug. The plug is formed with side channels within which socket contacts at the end of an electrical wire or conductor may be snap fit. The receptacle includes side loading wedges aligned with the side channels of the plug to place a lateral load or compressive force on the socket contacts. The plug is formed with strain relief wedges that place a vertical load or compressive force on the socket contacts or wire insulation and conductor held therein. The plug and receptacle are formed with a key and keyway for proper orientation. An external latch on the receptacle captures the fully inserted plug.

19 Claims, 12 Drawing Sheets

FUEL INJECTOR CONNECTOR

BACKGROUND OF THE INVENTION

1. Field of the Invention

The present invention generally relates to electrical connectors and, more particularly, relates to an electrical connector assembly for connection to a fuel injector on an engine of a motor vehicle.

2. Description of Related Art

Electrical connectors are known in the art for various purposes. One type of connector is a fuel injector connector, which is provided inside of an engine compartment to connect electrical wires from a fuel injector controller to a fuel injector or actuator associated with the fuel injector. A fuel injector connector must make and retain a secure and reliable electrical connection amidst vibrations and movements caused by an operating engine and moving motor vehicle, as well as the heat and pressure of an internal combustion engine. The difficulty of making a secure and reliable connection is magnified in heavy transport and diesel engine applications such as truck, bus, construction, etc. vehicles.

In the prior art, one common way of making an electrical connection is by use of stud terminals on the fuel injector (or actuator) that engage ring or spade terminals on the electrical wires. The ring or spade terminals are fitted over the stud terminals and capped by stud fasteners or nuts. Torque is applied to the stud fasteners to secure the connection. A special tool is typically required for this operation. This method of making the connection has several disadvantages. Multiple parts and significant time and effort are required to make the connection. The stud fasteners may be dropped and lost during assembly, and may break off after a period of operation.

Other prior art connectors use a mating receptacle and plug pair to complete an electrical connection. The security and reliability of such a connection is dependent on the fit between the receptacle and plug. If the fit is too loose, the plug may move inside or fall out of the receptacle in response to engine and vehicle vibration and movement. If the fit is too tight, the heat and pressure on the receptacle and plug may lead to deformation and failure of the connection.

SUMMARY OF THE INVENTION

The present invention provides a fuel injector connector that is secure, reliable, simple-to-assemble and capable of withstanding the vibrations and other environmental factors associated with diesel engines and heavy transport applications. It is a mating receptacle and plug configuration, having a tight fit with loads applied in lateral and vertical directions. A key and keyway ensure proper alignment and provide further limitation of movement, and an external latch captures the fully inserted plug.

In one embodiment of the invention, an electrical connector assembly is provided. The assembly includes a plug with side channels within which socket contacts at a terminal end of an electrical wire are received. The plug also includes first load elements that place a first load on the socket contacts or electrical wire. The assembly also includes a receptacle having pin terminals configured to mate with the socket contacts. Second load elements are formed in the receptacle and aligned with the side channels of the plug to place a second load on the socket contacts.

In another embodiment of the invention, an electrical connector assembly for a fuel injector is provided. A plug has side channels within which socket contacts at a terminal end of an electrical wire are snap fit. Strain relief wedges are formed at a trailing end of the plug. Contact between the strain relief wedges and inner surfaces of the receptacle forces the strain relief wedges away from the receptacle and applies a vertical load to the socket contacts or electrical wire. The plug also includes a key. A receptacle with pin terminals is configured to mate with the socket contacts of the plug. Side loading wedges protrude from inner side surfaces of the receptacle and press against and place a lateral load on the socket contacts. A keyway formed in the receptacle receives the key of the plug to ensure proper insertion and limit movement of the plug. A latch is attached to the receptacle and moveable between an open position to allow insertion of the plug and a closed position to capture the inserted plug.

Another embodiment of the invention is an electrical connector assembly for use in an engine compartment of a heavy transport vehicle. The assembly has a mating plug and receptacle configuration and comprises first vibration-resistant means for creating a compressive force between the plug and the receptacle in a first direction, and second vibration-resistant means for creating a compressive force between the plug and the receptacle in a second direction.

Other features and advantages of the invention will be apparent from the following detailed description, taken in conjunction with the accompanying drawings which illustrate, by way of example, various features of embodiments of the invention.

BRIEF DESCRIPTION OF THE DRAWINGS

FIG. 1(*b*) is another perspective view of the plug and receptacle of FIG. 1(*a*).

FIG. 1(*c*) is a perspective view of the fuel injector connector of FIG. 1(*a*) showing the plug secured in the receptacle.

FIG. 3(*b*) is a perspective view of a socket contact snapped into a plug according to the present invention.

DETAILED DESCRIPTION OF THE INVENTION

Reference will now be made to the drawings wherein like numerals refer to like parts throughout.

Figure 1A:
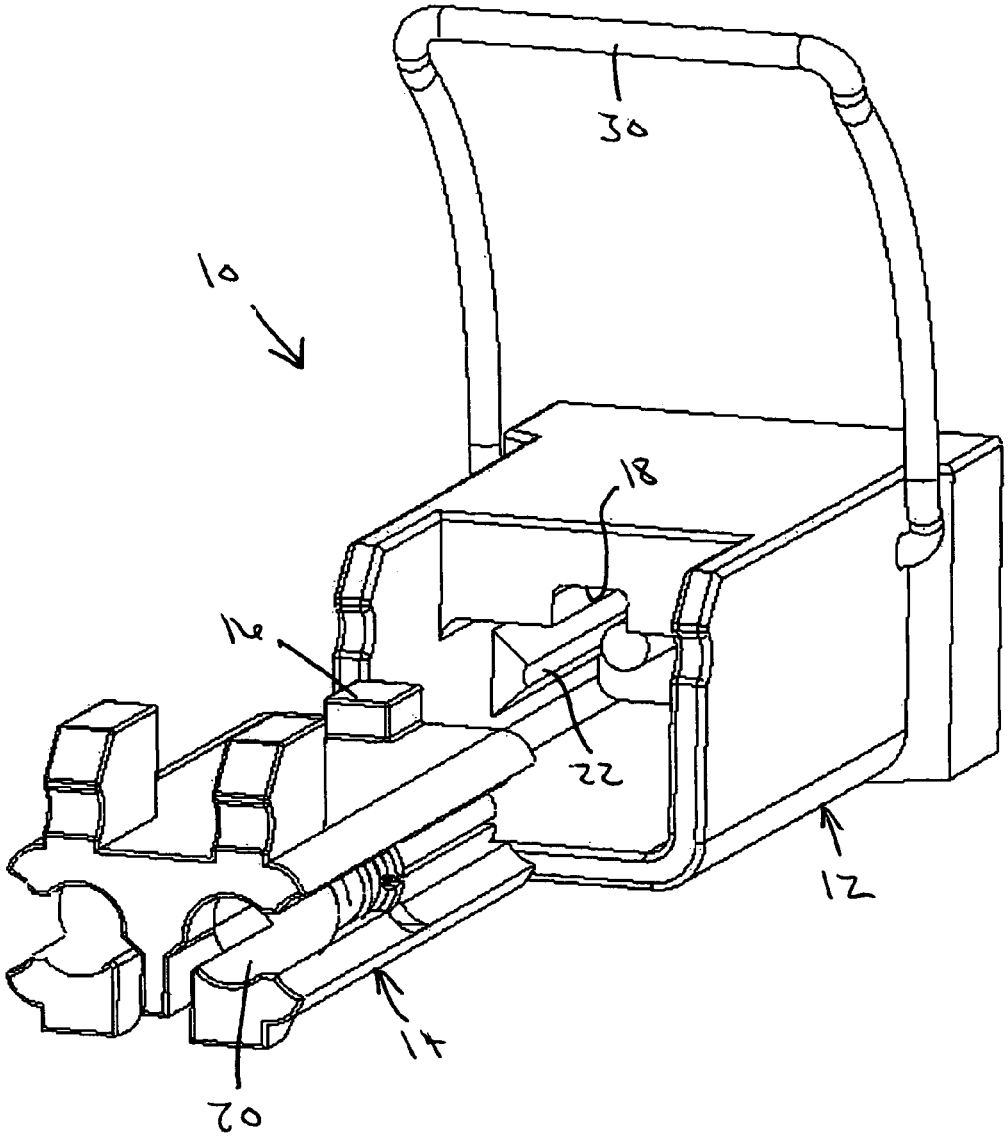
FIG. 1(*a*) is a perspective view of a plug and receptacle of a fuel injector connector according to the present invention.
Figure 1B:
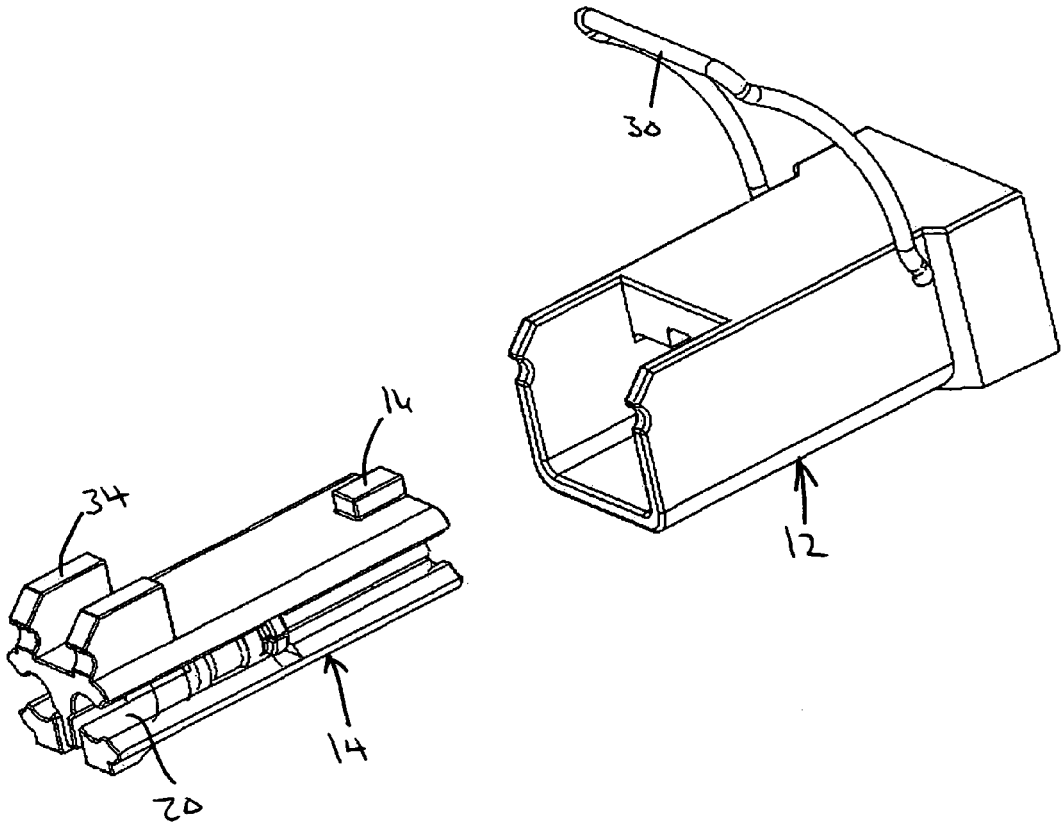
Figure 1C:
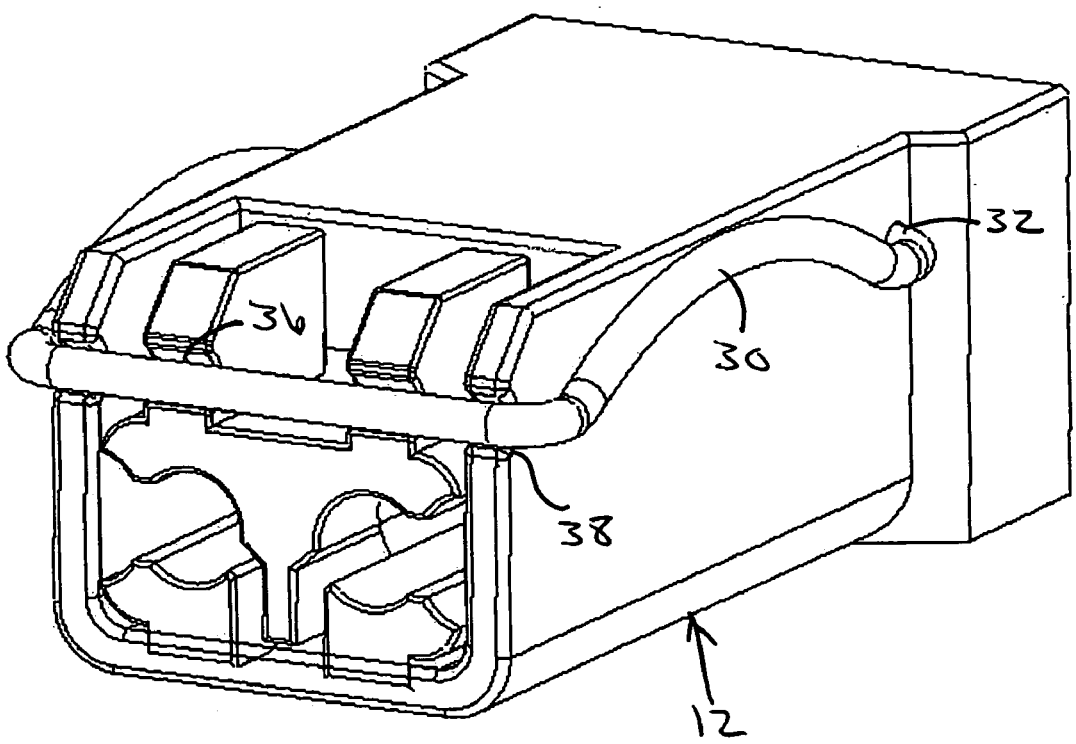
Figure 2:
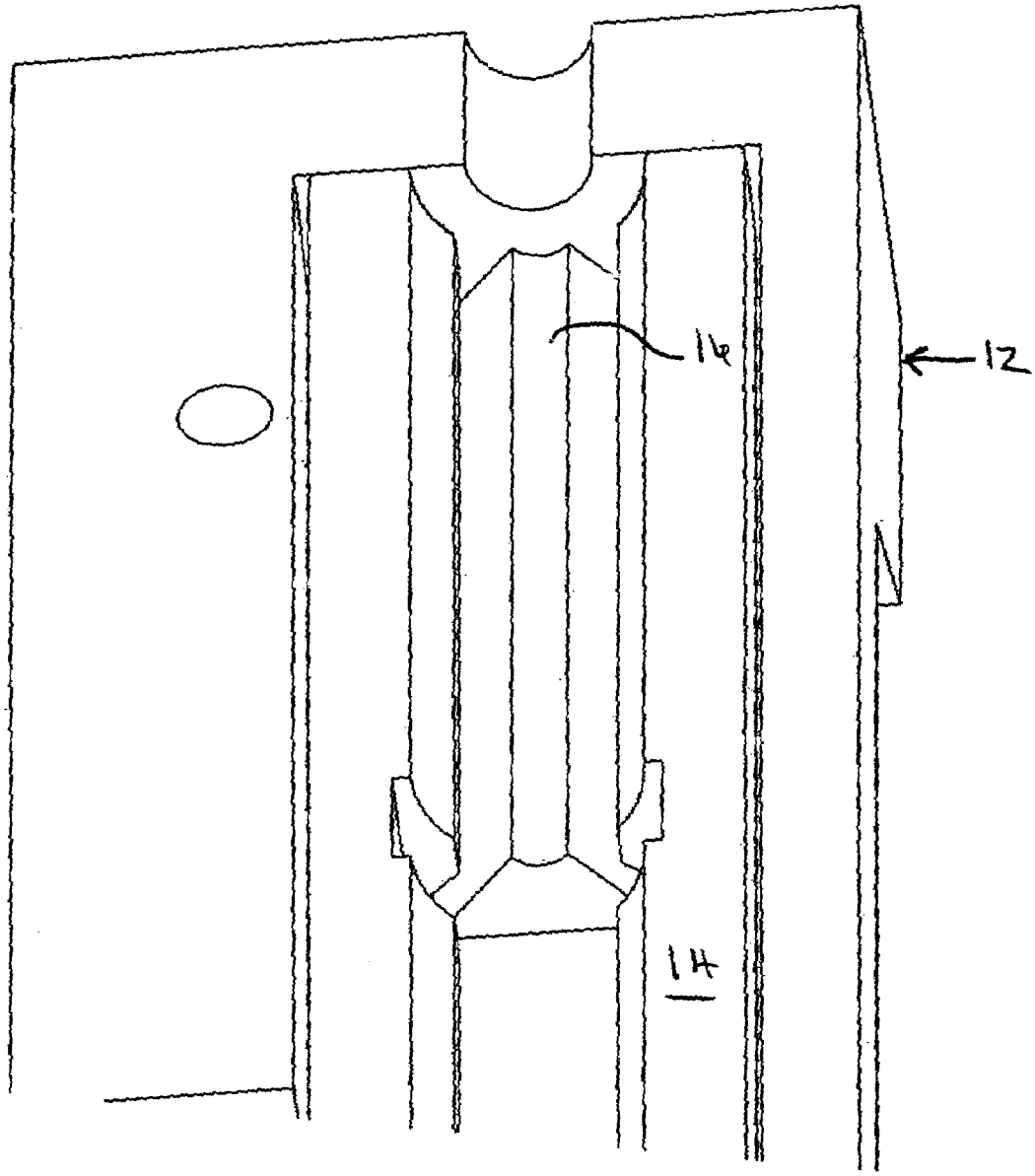
FIG. 2 is a cross-sectional view of the mated plug and receptacle of FIG. 1(*c*).

A first embodiment of a fuel injector connector 10 according to the present invention is illustrated in FIGS. 1–8. Connector 10 provides an electrical connection between a fuel injector (not shown) and fuel injector controller (not shown). As shown in FIGS. 1(*a*)–(*c*), connector 10 includes a receptacle 12 that receives and mates with a plug 14. Receptacle 12 and plug 14 may be made of an appropriate flexible yet rigid material, such as glass-filled nylon. As will be described, receptacle 12 and plug 14 are formed with various features to ensure a snug, tight and secure fit sufficient to withstand movement, vibrations and other environmental hazards seen by heavy transport vehicles.

Figure 3A:
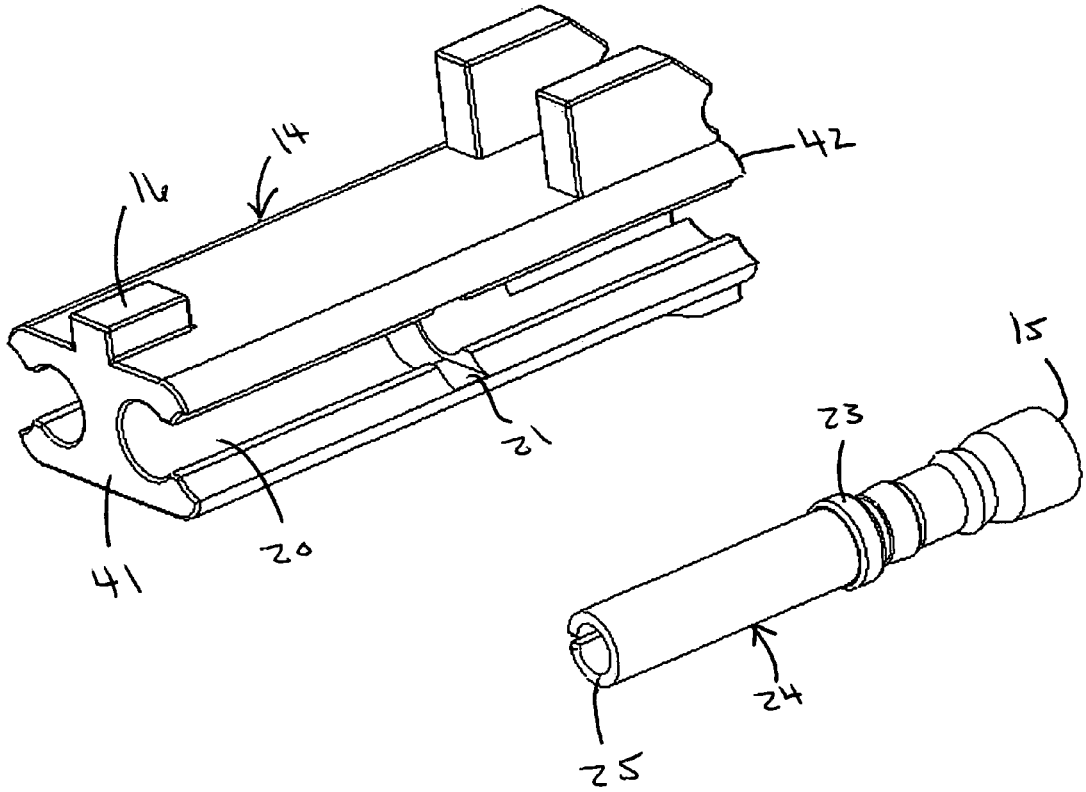
FIG. 3(*a*) is a perspective view of a socket contact and plug according to the present invention.
Figure 3B:
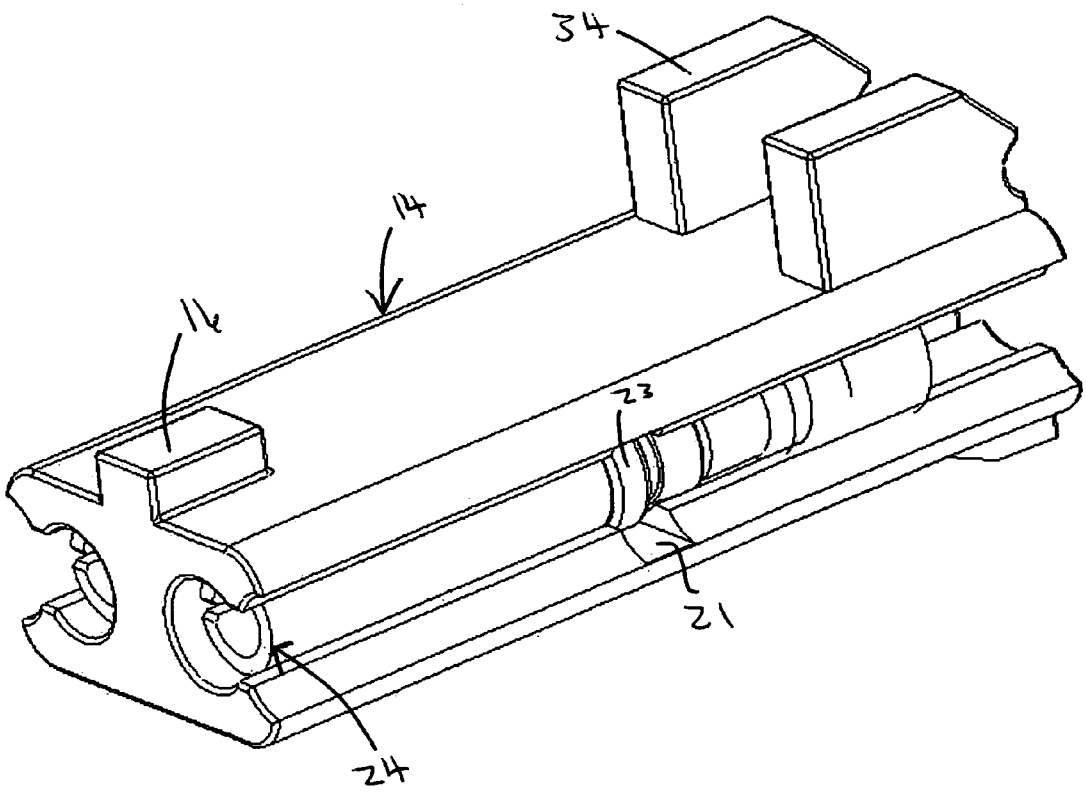

Plug 14 is formed with side openings or channels 20 formed to securely seat an electrical conductor, such as a socket contact 24 (FIGS. 3(*a*)–(*b*)). As is known to those of skill in the art, a socket contact is a female-type conductive element that receives a terminal end of a wire at one end 15, and mates with a pin male-type contact at another end 25. In use, socket contact 24 is typically crimped between socket contact end 15 and flange 23 around the bare or stripped portion of the electrical wire to establish a mutual flow of metal, as well as around the insulated portion of the wire adjacent end 15. When in mating engagement within receptacle 12, the mating ends 25 of socket contacts 24 receive and form an electrical connection with pin terminals 26 protruding from a rear inner wall 28 of receptacle 12. Pin terminals 26, when in use, are in electrical communication with another component such as the actuator of a fuel injector.

Socket contacts 24 are preferably snap fit within channels 20 for a tight, secure fit. In one embodiment, exterior flange 23 formed on socket contact 24 fits within a corresponding annular recess 21 in channel 20 to ensure proper orientation and positioning of sockets 24 in channels 20. Thus, assembly of socket contacts 24 and plug 14 is a simple procedure requiring no tools and may be verified by a visual check.

Plug 14 may be formed with a key 16 that engages and moves within a mating keyway 18 formed in receptacle 12 to ensure that plug 14 is oriented and inserted properly into receptacle 12. Key 16 and keyway 18 also serve to limit movement and rotation of plug 14 relative to receptacle 12. In one embodiment, key 16 is formed on an upper surface at the leading end 41 of plug 14, while keyway 18 is formed in an upper, inner surface of receptacle 12. It should be understood, however, that key 16 and keyway 18 could be disposed in alternative configurations. Key 16 could be located on a bottom, inner surface of receptacle 12, for example, with a keyway 18 formed on a bottom surface of plug 14.

Figure 4:
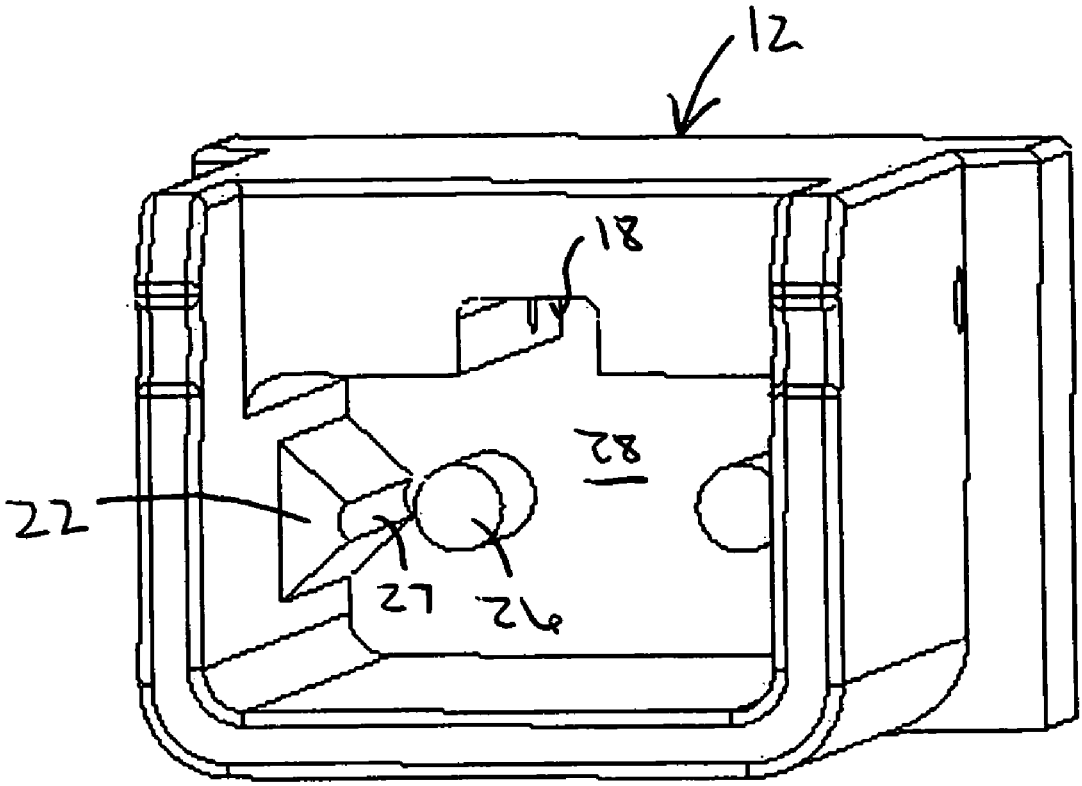
FIG. 4 is an enlarged end view looking into the plug of FIG. 1(*a*).
Figure 5:
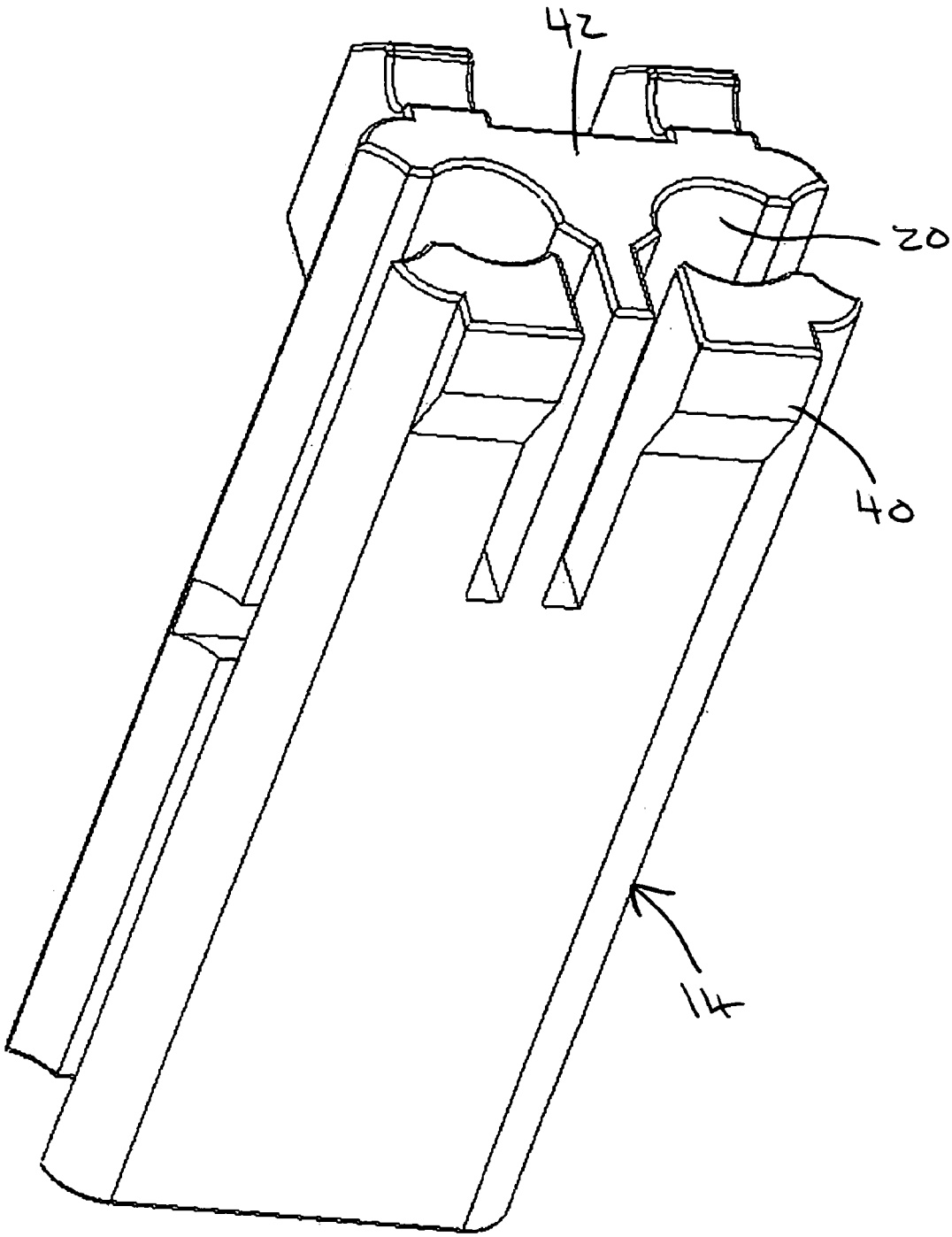
FIG. 5 is an enlarged perspective view of the bottom of the plug of FIG. 1(*a*) showing strain relief wedges according to the present invention.
Figure 6:
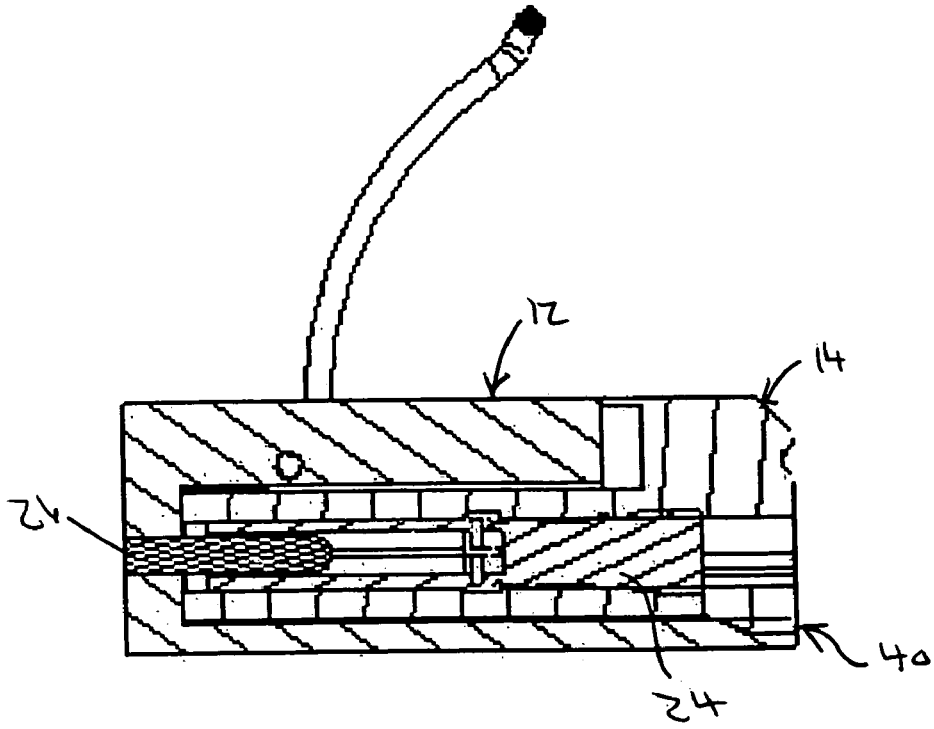
FIG. 6 is a cross-sectional view of the mated plug and receptacle taken along lines I—I of FIG. 1(*c*), showing compression of the strain relief wedges.
Figure 7:
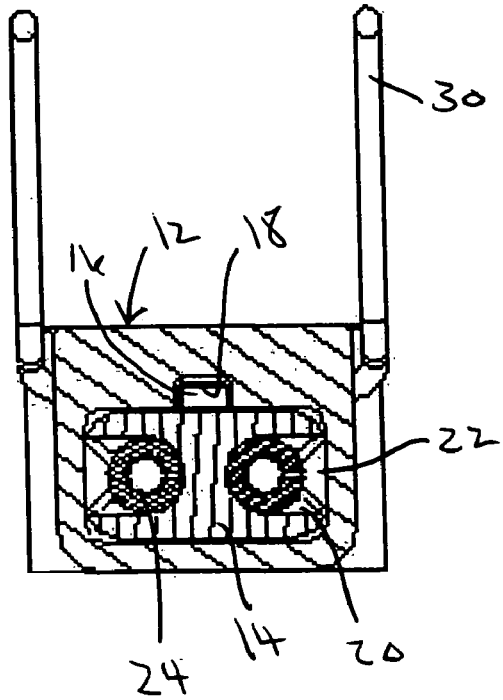
FIG. 7 is a cross-sectional view of the mated plug and receptacle taken along lines II—II of FIG. 1(*c*), showing receptacle wedge side loading at the socket contacts.

As best seen in FIG. 4, side loading wedges 22 protrude from the interior side surfaces of receptacle 12. Wedges 22 are projecting, rib-like elements extending from the rear inner wall 28 of receptacle 12 to an end surface or shoulder 19. Wedges 22 are positioned such that they are aligned length-wise with channels 20 and socket contacts 24 of an inserted plug 14. Wedges 22 press against and place a side or lateral load or compressive force on socket contacts 24 to enhance the tight fit between receptacle 12 and plug 14, and to prevent any relative movement or slippage therebetween. Thus, contacts 24 and plug 14 are restrained along a lateral or horizontal axis. Hoop stress is applied to contacts 24 by the inner diameter of plug 14 as well. The inner diameter of wedge 22 may be formed with a curved recess 27 (FIG. 4) that matches the outer curvature of socket contacts 24, such that socket contacts 24 are both cradled and side loaded by wedges 22.

In addition to lateral loading means in the form of side wedges 22, connector 10 includes vertical loading means in the form of strain relief wedges 40. Strain relief wedges 40 are formed in plug 14 and are configured to place a vertical load or compressive force on socket contacts 24 and the electrical wire held therein. In one embodiment, strain relief wedges 40 are formed on a lower surface at the trailing end 42 of plug 14 (i.e. the end of plug 14 opposite the leading end 41 that engages pin terminals 26), aligned with channels 20. Strain relief wedges 40 protrude slightly from the lower surface of plug 14 so that, when plug 14 is fully inserted into receptacle 12, contact between strain relief wedges 40 and the inner surfaces of receptacle 12 forces strain relief wedges 40 away from receptacle 12 and thereby constricts channel 20 at the trailing end. When a socket contact 24 is properly oriented and seated within channel 20, strain relief wedges 40 apply a load to the socket contact insulation crimp and wire insulation. Contacts 24 and the wires and insulation crimped therein are restrained along a vertical axis. Thus, strain relief wedges 40 prevent movement of the electrical wire and insulation within socket contact 24, and also relieve the strain on and prevent damage to the conductive crimp formed directly between the socket contact and bare electrical wire adjacent mating end 25 of contact 24.

Figure 8:
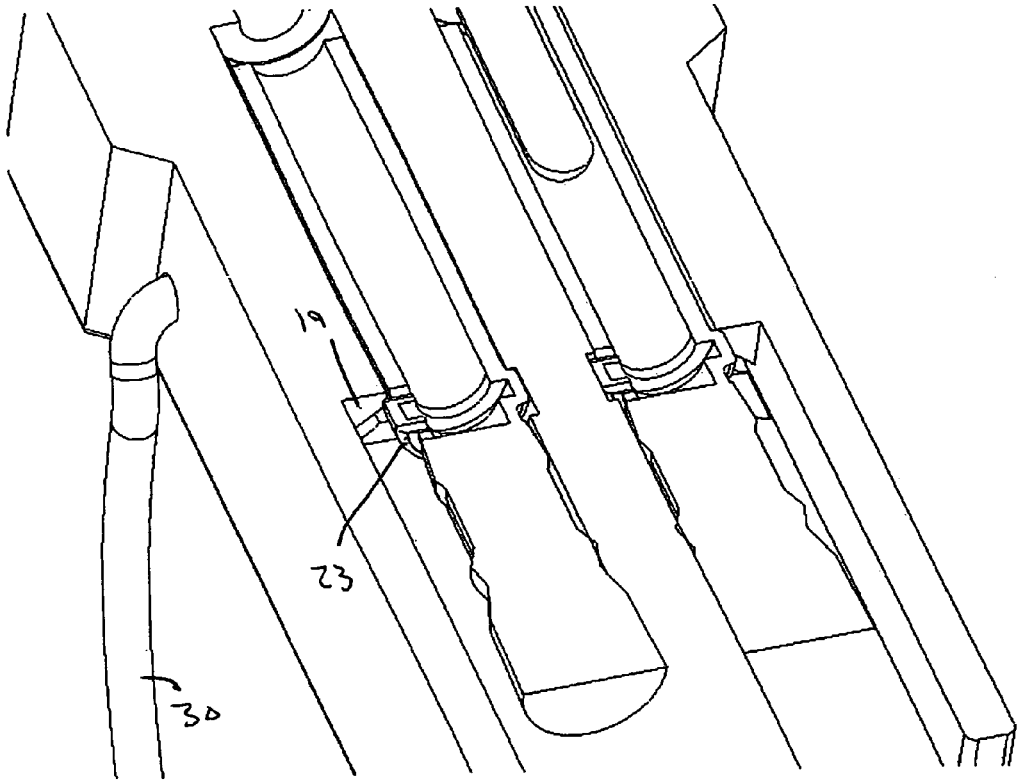
FIG. 8 is a cross-sectional view of the mated plug and receptacle taken along lines III—III of FIG. 1(*c*), illustrating the stop of the socket contact at the receptacle wedge shoulder.

As is best seen in FIG. 8, when plug 14 is inserted into receptacle 12, annular flanges 23 formed on the exterior of socket contacts 24 contacts the outer shoulders or ends 19 of side wedges 22 to create a hard stop for insertion of plug 14 into receptacle 12.

In one embodiment, a wire bail or latch 30 is attached and rotatable about the outside of receptacle 12 at pivots 32. Bail 30 is movable between an open position, illustrated in FIG. 1(*a*), in which plug 14 may be inserted into receptacle 12, and a closed position, illustrated in FIG. 1(*c*), in which plug 14 is secured within receptacle 12 after full insertion. In one embodiment, in the closed position, protrusions 34 extending from an upper surface of plug 14 are trapped and secured between wire bail 30 and a wall of receptacle 12. Bail 30 may snap within aligned channels 36 and 38 formed, respectively, in the end surfaces of receptacle 12 and plug 14 (protrusions 34) to lock bail 30 in the closed position.

Thus, connector 10 provides hoop-style loading about both the vertical and horizontal axes with a result of zero movement of the plug relative to the receptacle. Superior ability to withstand vibration is provided. In one test, a connector according to the present invention withstood 60 G vibration for eight hours continuous. The connector design is robust and has minimal parts and no complicated connective mechanisms. No special assembly tools are required.

Figure 9:
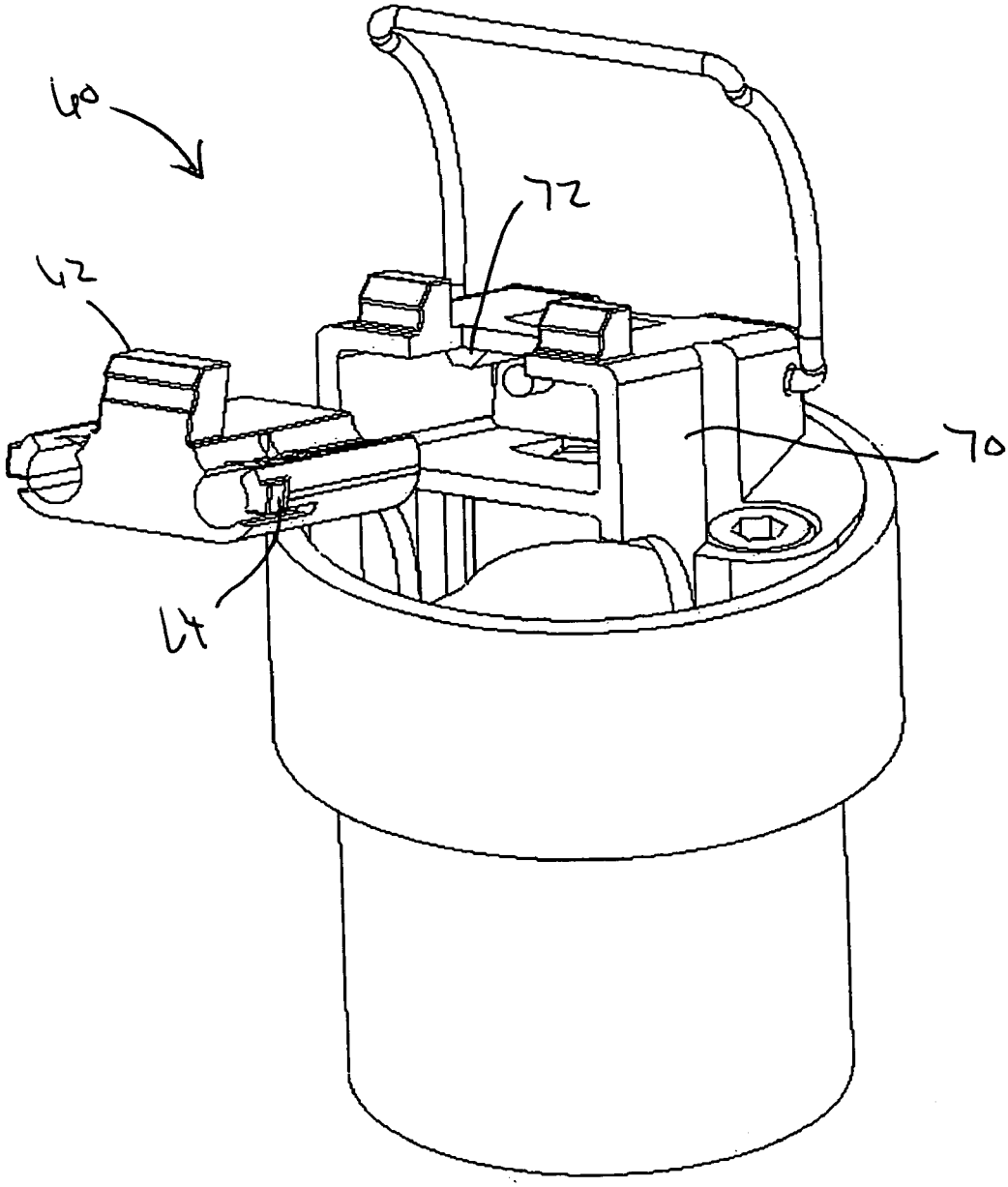
FIG. 9 depicts another embodiment of a connector according to the present invention.

An alternative embodiment of the invention is illustrated in FIG. 9. Connector 60 includes a plug 62 and receptacle 70 employing the same principles as described with reference to connector 10. However, receptacle wedges 72 are formed at the top, rather than the sides, of receptacle 70. Stain relief wedges 64 are formed on the sides, rather than on the bottom of plug 40. The result is still hoop style loading about all axes of the connector for a secure, vibration-resistant connection.

Figure 10:
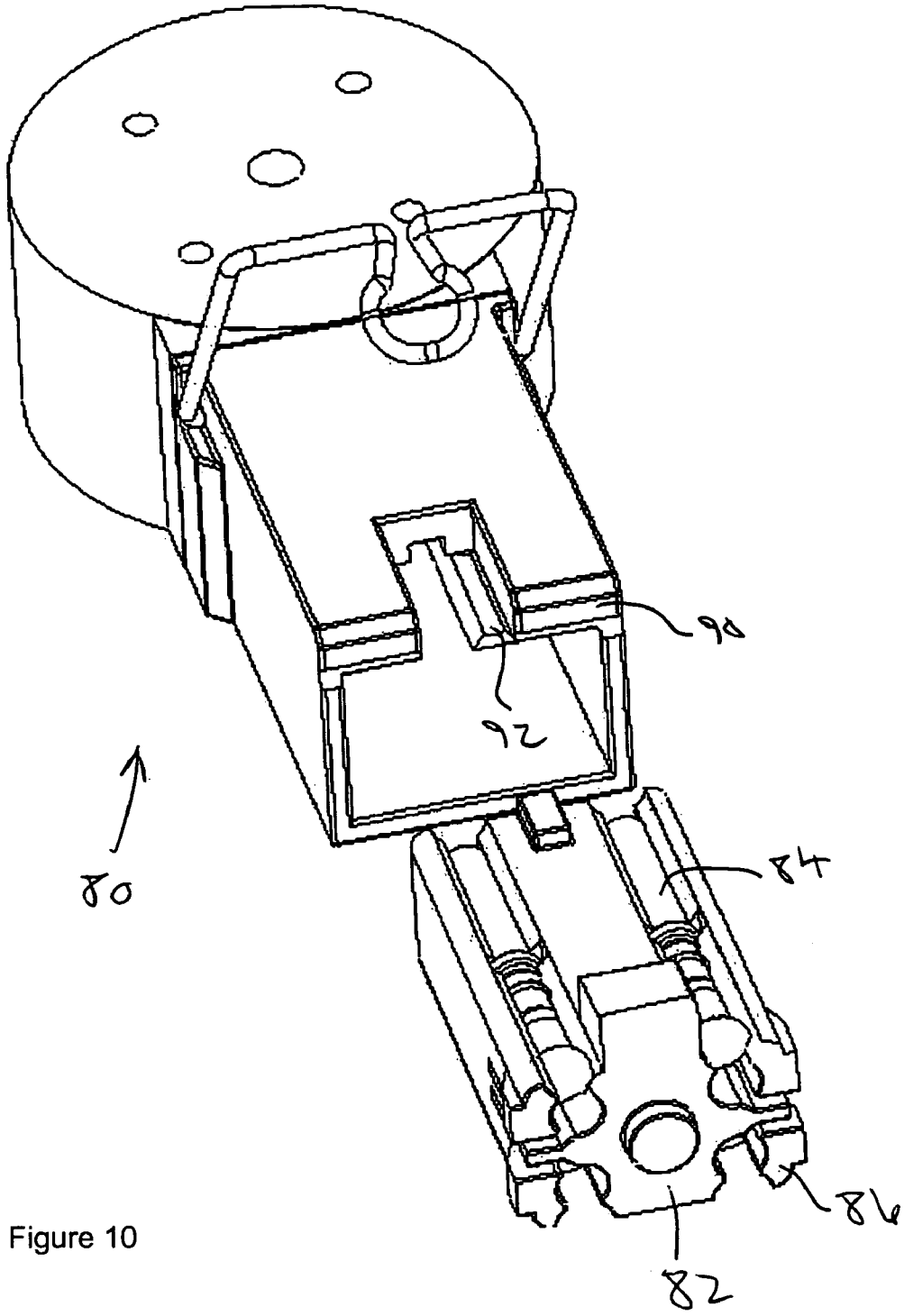
FIG. 10 depicts another embodiment of a connector according to the present invention.

Another embodiment of the invention is illustrated in FIG. 10. Connector 80 includes a plug 82 and a receptacle 90 employing the same principles as described with reference to connector 10. Connector 80 has four socket contacts 84 and corresponding channels formed within plug 82. Four receptacle wedges 92 are formed on the top and bottom interior surfaces of receptacle 90 in alignment with the socket contact channels. Strain relief wedges 86 are formed at the corners of the trailing end of plug 82. The result is again hoop-style loading about all axes of the connector.

The description above refers to particular embodiments of the present invention and is intended to be illustrative rather than restrictive. While the connector is described in conjunction with a fuel injector, for example, the inventive connector structure may be appropriate in other applications where a tight and vibration-resistant connection is needed. Modification to the described embodiments may be made without departing from the spirit and scope of the invention as defined by the appended claims.

The invention claimed is:

1. An electrical connector assembly comprising:

a plug comprising side channels within which socket contacts at a terminal and of an electrical wire may be received; and first load elements to place a first load on the socket contacts or electrical wire; and a receptacle comprising pin terminals configured to mate with the socket contacts, and second load elements that are aligned with the side channels of the plug to place a second load on the socket contacts, wherein the plug extends between a leading end that is inserted into the receptacle and a trailing end, and wherein the side channels are open to one side between the leading end and the trailing end on full length of the plug.

2. An electrical connector assembly as claimed in claim 1, wherein the first load elements are strain relief wedges formed at the trailing and of the plug, and wherein contact between the strain relief wedges and inner surfaces of the receptacle forces the strain relief wedges away from the receptacle and thereby applies a vertical load to the socket contacts or electrical wire.

3. An electrical connector assembly as claimed in claim 1, wherein the side channels are configured for a snap fit of the socket contacts therein.

4. An electrical connector assembly as claimed in claim 1, wherein each side channel is formed with a recess to receive an exterior annular flange formed on the socket contact.

5. An electrical connector assembly as claimed in claim 1, wherein the second load elements further define shoulders against which annular flanges of the socket contacts come to a hard stop at a fully inserted position of the plug into the receptacle.

6. An electrical connector assembly as claimed in claim 1, wherein the latch and the plug are formed from glass-filled nylon.

7. An electrical connector assembly as claimed in claim 1, wherein the plug is connected to the terminal end of the wire in communication with a fuel injector controller, and the receptacle is in communication with a fuel injector actuator.

8. An electrical connector assembly as claimed in claim 1, wherein the second load elements are side loading wedges protruding from inner side surfaces of the receptacle, the side loading wedges pressing against and placing a lateral load on the socket contacts.

9. An electrical connector assembly as claimed in claim 8, wherein a curved recess is formed on an inner surface of each side loading wedge to cradle a curved outer surface of the socket contacts.

10. An electrical connector assembly as claimed in claim 1, and further comprising a key formed in the plug that fits within a keyway formed in the receptacle to ensure proper insertion of the plug into the receptacle and to limit movement of the plug relative to the receptacle.

11. An electrical connector assembly as claimed in claim 10, wherein the key is formed on an upper surface at the leading end of the plug and the keyway is formed in an inner, upper surface of the receptacle.

12. An electrical connector assembly as claimed in claim 1, wherein a latch is attached to the receptacle, the latch being moveable between an open position to allow insertion of the plug and a closed position to capture the inserted plug.

13. An electrical connector assembly as claimed in claim 12, wherein the latch is a wire bail.

14. An electrical connector assembly for a fuel injector comprising:

a plug comprising side channels within which socket contacts at a terminal end of an electrical wire may be snap fit, strain relief wedges formed at a trailing end of the plug, wherein contact between the strain relief wedges and inner surfaces of the receptacle forces the strain relief wedges away from the receptacle and applies a vertical load to the socket contacts or electrical wire, and a key; and a receptacle comprising pin terminals configured to mate with the socket contacts, and side loading wedges protruding from inner side surfaces of the receptacle, the side loading wedges pressing against and placing a lateral load on the socket contacts, and a keyway that receives the key of the plug to ensure proper insertion and limit movement of the plug; and a latch attached to the receptacle, the latch being moveable between an open position to allow insertion of the plug and a closed position to capture the inserted plug.

15. An electrical connector assembly for use in an engine compartment of a heavy transport vehicle, the assembly having a mating plug and receptacle configuration and comprising:

a plug extending between a leading end that is inserted into a receptacle and a trailing end, the plug comprising side channels that are open to one side between the leading end and the trailing end;

first vibration-resistant means for creating a compressive force between the plug and the receptacle in a vertical direction; and second vibration-resistant means for creating a compressive force between the plug and the receptacle in a horizontal direction wherein socket contacts of the plug at a terminal end of electrical wire may be received within said side channels.

16. An electrical connector assembly as claimed in claim 15, and further comprising orientating means for ensuring proper orientation and insertion of the plug into the receptacle.

17. An electrical connector assembly as claimed in claim 16, and further comprising latch means for capturing the plug within the receptacle.

18. An electrical connector assembly as claimed in claim 17, wherein the first vibration-resistant means comprises side loading wedges formed on an inner surface of the receptacle that place a lateral load on socket contacts carried by the plug.

19. An electrical connector assembly as claimed in claim 18, wherein the second vibration-resistant means comprises strain relief wedges formed in the plug that place a vertical load on the electrical wire carried by the plug when inserted into the receptacle, and relieve stress on a crimp between the socket contact and bare wire.

* * * * *